United States Patent [19]

Lymar et al.

[11] 4,084,290

[45] Apr. 18, 1978

[54] SLIDING DOOR AND WINDOW STOP

[76] Inventors: Wasyl Lymar, 607 Williams St., Broderick, Calif. 95605; Alice Jean Manley, 1710 V St., Sacramento, Calif. 95818

[21] Appl. No.: 772,247

[22] Filed: Feb. 25, 1977

[51] Int. Cl.[2] ..... A47H 1/04; A47H 15/00

[52] U.S. Cl. ..... 16/96 R; 49/404; 428/40; 428/41; 16/87 R

[58] Field of Search ..... 16/82, 49, 87, 87.4, 16/87.4 W, 87.6 W, 94 R, 95 R, 96 R; 160/19, 123, 330, 191; 104/89-111; 49/404, 413; 428/40, 41, 42, 343

[56] References Cited

U.S. PATENT DOCUMENTS

| | | | |
|---|---|---|---|
| 2,937,416 | 5/1960 | Hiers | 49/449 X |
| 2,950,756 | 8/1960 | Moloney | 49/449 |
| 3,409,257 | 11/1968 | Elm | 248/205 A X |
| 3,696,920 | 10/1972 | Laway | 248/205 A |
| 3,698,883 | 4/1971 | Fazio | 49/449 |
| 3,714,738 | 2/1973 | Koslow et al. | 49/404 |
| 3,810,596 | 5/1974 | Elm | 248/205 A X |
| 3,900,059 | 8/1975 | Kirk et al. | 248/205 A X |
| 4,004,325 | 1/1977 | Hubachek | 248/205 A X |

*Primary Examiner*—Ronald Feldbaum
*Attorney, Agent, or Firm*—Mark C. Jacobs

[57] ABSTRACT

A stop for limiting the upward movement of closures such as slidable windows and doors, which stop has a body portion adhesively securable to the frame of said window or door and limiting the upward movement of said window or door within said frame.

16 Claims, 12 Drawing Figures

SLIDING DOOR AND WINDOW STOP

BACKGROUND OF THE INVENTION

The recent upsurge of crime within the urban and suburban areas of this country has caused a great deal of anxiety to the residents thereof and particularly to the women-folk. All too often criminals have been able to enter homes which the owners thought were locked and secure. Entrance has been gained by simply removing sliding glass doors and sliding windows from their frames without the necessity of having to break or crack the glass. Thus entrance can be had quickly and quietly. The fact remains that many doors and most windows which slide within a channel, are not prevented from the inside from being removed from said channel from the outside. The frame of said sliding glass doors and windows is generally sized larger such that the slidable door or window, whether or not in a normally locked position, may be lifted up within said frame's channel work and readily removed therefrom. Indeed, this is the normal manner, but carried out in reverse order, for the mounting of said slidable doors and windows within their channel framework. One of the tools employable by burglars and robbers to effect such glass door and window removal is the plumber's friend, i.e. a a large suction cup mounted on a handle.

This invention relates to a stop for preventing the removal of sliding glass doors and windows from the channel by mere lifting of said window or door upwardly and outwardly.

SUMMARY OF THE INVENTION

This invention provides a novel solution to the problem set forth above by providing a new and improved stop for preventing the upward movement of windows and doors that slide within a framework from being removed therefrom readily from the outside. The instant device is seen to comprise a solid body portion which is adhesably securable to the channel material forming the frame for said window or door. In an alternate embodiment, an adjusting means is provided for decreasing the gap between the bottom of said body portion and the top of said window or door. In a third embodiment, the body portion comprises a plurality of superposed, releasably secured bonded layers.

Accordingly, it is an object of this invention to provide a new and improved stop for the prevention of the opening and removal of such closures as sliding windows and doors which are securable within a frame and which invention is mounted for movement in said frame.

Another object is to provide a stop for a closure which is easily securable to the closure frame and which will not mar or scar the frame member.

Yet another object is to provide a stop which is low in price, thereby being readily marketable and which is easily manufactured.

A further object is to provide a stop for a window or door which is slidable or movable in a stationary frame defining the window or door opening, with the stop having means for rigidly securing it to the frame member in position.

A still further object is to provide a stop having an adhesively securable means for attaching said stop to said frame member.

One further object is to provide a stop which may be sizeably altered to reduce the stop to the desired size for insertion on a window or door frame member.

Yet another object is to provide an adhesively securable stop to prevent the upward movement of a door or window from its frame, wherein said stop has a means therein for enlarging or reducing the gap between the top of said door or window and the stop.

Additional objects and advantages of the instant invention become apparent to the reader from the following detailed description of the invention when taken in conjunction with the accompanying drawings wherein.

Figure 5A:
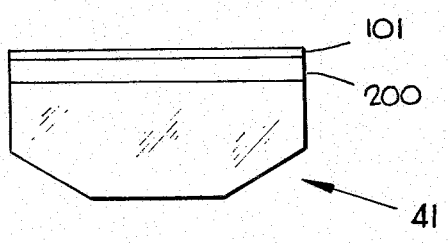

FIG. 5*a* is an elevational view of yet another embodiment of this invention.

Figure 5B:
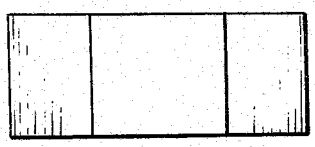

FIG. 5*b* is a bottom view thereof.

Figure 1:
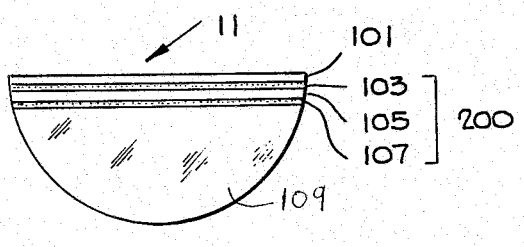
FIG. 1 is an elevational view of one embodiment of the window or door stop of this invention.
Figure 6:
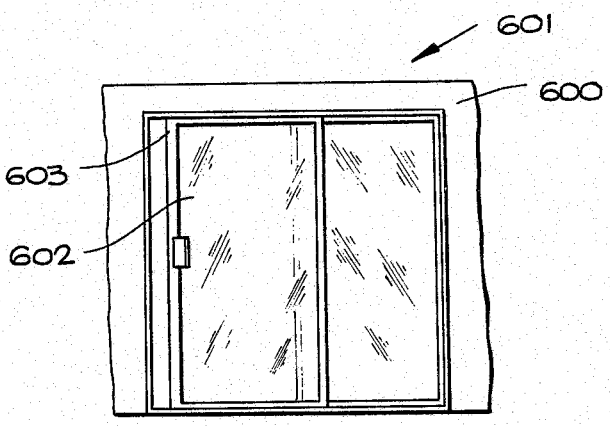

FIG. 6 is a front view of a slidable door or window within its frame and showing the stop of FIG. 1 placed in operative location.

Figure 6A:
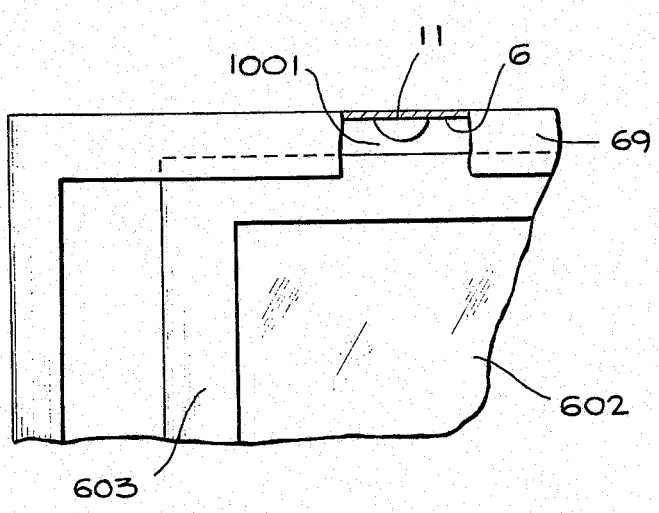

FIG. 6*a* is a close up view of a portion of FIG. 6, showing part of the door frame with the stop in place and a portion of the top wall of the door.

Figure 7:
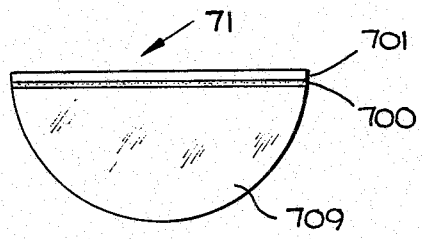

FIG. 7 is an elevational view of yet another embodiment of the instant invention wherein a single non-backed adhesive layer is employed.

Figure 2:
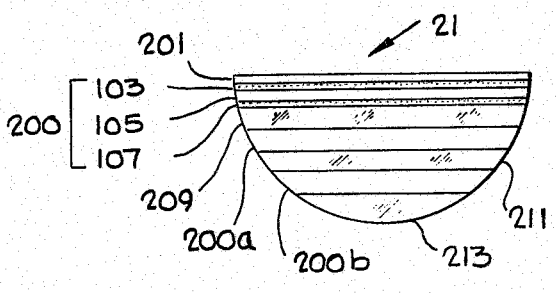
FIG. 2 is an alternate embodiment shown in elevation.
Figure 3:
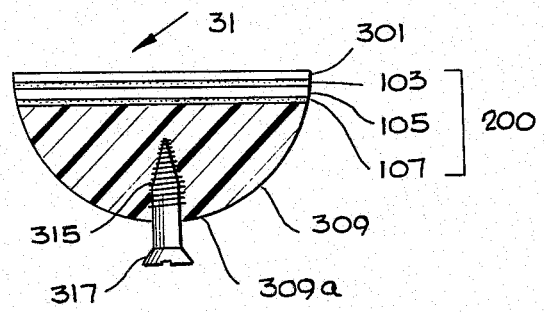
FIG. 3 is a vertical sectional view of a third embodiment of this invention wherein a gap dimension changing means is shown inserted into the body of the stop.
Figure 8:
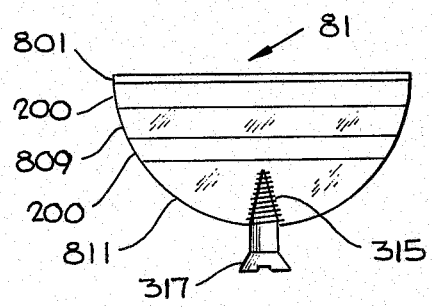

FIG. 8 is seen to be an elevational view of an embodiment of the invention that combines the features of the embodiments of FIGS. 2 and 3.

Figure 9:
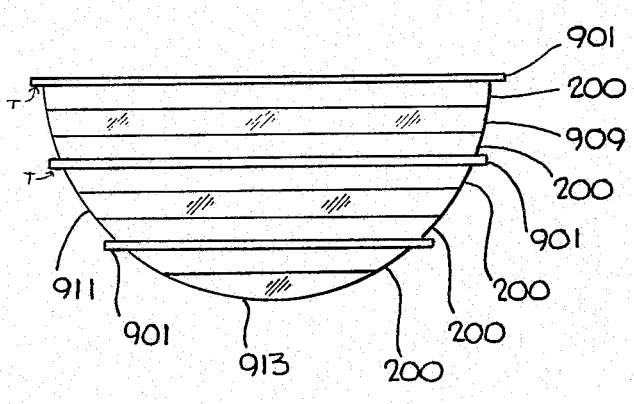

FIG. 9 is another embodiment that features easily severable layers for size adjustment, and is shown in elevation.

Figure 10:
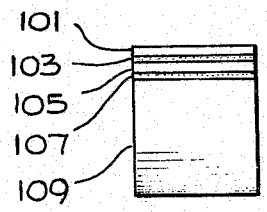

FIG. 10 is an end view of the embodiment of FIG. 1.

DESCRIPTION OF THE PREFERRED EMBODIMENT

Referring now to the figures there is shown in FIG. 1, an embodiment of the instant window or door stop. The instant stop is intended to impede the upward vertical movement of the door or window within its channel framework. As such the stop 11 is seen to comprise a plurality of superposed layers comprising an adhesive structure upon a body portion 109. The uppermost layer 101 is a release layer which covers over a pressure-sensitive adhesive layer 103. The release layer is made of a material, e.g. silicone treated paper which will adhere to and yet may be easily removed from the pressure sensitive adhesive layer 103, without affecting the adhesive characteristics of the adhesive. The adhesive 103 may comprise any adhesive material capable of adhering to metal such as aluminum, steel and magnesium, as well as to wood.

Directly beneath the adhesive layer 103 is backing coat 105. Such materials are readily known to the art for such purpose. On the reverse side of the backing coat, also in superposed relationship, is a second adhesive coat 107. Adhesive coat 107 may be of the same or different chemical make up as adhesive coat 103. The criterion is that adhesive coat 107 must be capable of adhering to body portion 109. Body portion 109 may be made of metal, plastic, wood, hard rubber and the like. In a preferred embodiment it was found that acrylic plastic such as Plexiglass® sold by Rohn & Haas or Lucite sold by E. I. du Pont de Nemours. The same material or different material may be employed for each layer of the multilayered body portions. The same materials including acrylic, aluminum, and hardwood such as oak may be employed for both the 109 body portions and the body portions of the other embodiments to be described below.

Typically, the release layer 101, the adhesive 103, the backing coat 105 and the second adhesive layer 107 are available as one structure in the market place. Such a tape is sold by Permacel, wherein the backing coat is a cloth material coated on both sides with adhesive. Overcoating both adhesive layers are release layers, one of which is removed prior to its disposition upon the body portion 109.

For ease of understanding, the combined adhesive backing coat and second adhesive layer shall be considered to be one structure and denoted herein further as 200.

In FIG. 2 there is disclosed a second embodiment of the instant invention wherein a plurality of superposed layers of body members are inter-spaced with adhesive structures 200 a&b. This plurality of layers may be as few as two and as many as may be desired. The structure would, in descending order from the top, include a release layer 201, adhesive structure 200, a body layer 209, another adhesive structure, followed by a body layer 211, ad infinitum. In FIG. 2 it is seen that the layers decrease in length the further they are spaced apart from the release surface. The primary reason for having a generally arcuate shaped structure is the fact that movement of a window or door in its channel framework is not always in a straight line path. Rather movements can be jerky due to the exertion of pressure in a slightly downward direction caused by one side of the door or the window, generally that side opposite the position of pressure exertion, to raise slightly upwardly into the recess of the channel. By having a curved surface, there is less tendency of impact having an adverse effect on the stop. That is the door or window would roll by the stop without tending to knock it from its secured location. That is to say, however, the arcuate shape is only a preferred embodiment and is not critical to the operation of the device.

FIG. 3 shows a vertical sectional view of a third embodiment of the instant invention. The embodiment denoted as 31 is seen to possess a release layer 301, superposed upon an adhesive structure 200, superposed itself upon a body portion 309. The body portion 309 is seen to be threaded vertically at 315, said threads communicating to the lower edge of the body portion denoted 309*a*. Screw 317, preferably a self-tapping screw, is threadingly engaged with the threads 315 of body portion 309. Screw 317 may be tightened or loosened as may be desired in order to adjust the gap between the head of 317 and the top of the door or window in the channel framework. 319 denotes screwhead in FIG. 4.

Figure 4:
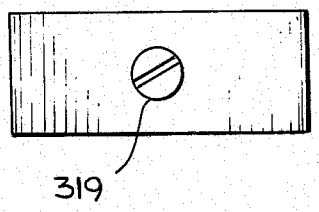
FIG. 4 is a bottom plan view of the stop of FIG. 3.

FIG. 4 is seen to be a bottom plan view of the vertical sectional view of the embodiment of FIG. 3.

Turning now to FIG. 8, it is seen that two body portions 809 and 811 have interspaced therebetween adhesive structures 200. The outer 200 structure has a release layer 801 thereupon. This embodiment is seen to combine the features of the FIG. 2 and FIG. 3 concept. In such embodiment the screw would be utilized for "fine tuning," or controlling to a lesser extent the dimensional change than is possible by the removal of a particular layer of adhesive and a corresponding body portion. 81 is the structure.

Shown in FIG. 5 is another vertical sectional view of yet another embodiment of this invention 41. This embodiment is similar to that shown in FIG. 1, but rather than having an arc shaped body, the body portion is substantially rectangular with the lower opposite corners being chamfered. FIG. 5*b* represents a bottom plane view of the embodiment of FIG. 5*a*.

In FIG. 6 there is shown the stop embodiment of FIG. 1 fixedly adhesed to the channel framework 11 of door frame 600. Shown in both the main figure and the closeup portion thereof is the top of the window or door that is slideable, 603. The gap therebetween is denoted as 1001. Normally, when said gap 1001 extends from the top wall inward side of channel member 601 to the top of the door or window 603, said space being denoted as 69 in the closeup view. However, when the gap is reduced by the placement in said space of a stop of this invention, it is reduced to the dimension shown as 1001. By employing the stop of the instant invention, one is prevented from lifting up the door in the framework and removing it outwardly or inwardly as one might desire for either harmless or harmful purposes.

In FIG. 7 there is shown an alternate format for the instant invention 71. Here, disposed directly beneath the release layer 701 is adhesive 700. This adhesive layer is adhered to the body portion 709. The coating of adhesive is such that its adherence capability is greater to the body portion 709 than it is to the release layer 701. Thus, when the release layer is removed, the adhesive remains adhered to the body portion. Such is, of course, the physical phenomenon involved with the ability to remove the release layer from the adhesive coating of the structure 200. It would seem that in providing an adhesive without a backing as is done in FIG. 7's embodiment, that the thickness of the layer of adhesive would have to be greater than would be the situation if a separate backer coat were employed as in the previously disclosed embodiments.

FIG. 8 has already been discussed above and so discussion turns now to FIG. 9. In this figure, there is shown an alternate format for ease of layer removal of the embodiment of FIG. 2. In descending order, the layers are seen to comprise superposed equidimensional layers of 901, release layer, adhesive structure 200, body portion 909, followed by a repetition of adhesive structure 200, release layer 901, adhesive structure 200, a second body portion 911, followed by another adhesive structure 200, a succeeding release layer 901, followed in order by another adhesive layer 200 and a final body portion 913. While not shown here, it is obvious that a gap adjusting means such as the screw of the embodiment of FIG. 3 can also be employed herein. The format as shown herein has the dimension widthwise of the release layer 901 slightly larger which extra measure is denoted as the portion T on the middle release layer. The overall size of the stop is adjusted by peelingly removing that portion of the composite unit that precedes any particular release layer. Thus if the release layer 901 denoted with an asterisk is removed, then all layers above same will also be removed, leaving adhesive layer 200 to be adhered to the door or window channel framework. The material to be removed is removed by applying an upward pressure to tab portion T of the particular denoted release layer, here the asterisk indicated 1. The advantage of the tab is seen to be that all the material above said layer will be removed with lesser difficulty than if one were to employ the embodiment of FIG. 2.

It is also to be seen that included within the scope of this invention is a stop that combines the embodiment of FIG. 7, i.e. one employing a single adhesive layer, with the adjusting screw of the embodiment of FIG. 3.

It is further understood that a version employing a plurality of discrete adhesive layers in lieu of the plurality of adhesive structures as disclosed in FIG. 9, is also contemplated. Such version could include the tab means similar to that of the FIG. 9 embodiment, or said version can be exclusive of said tabs and thus resemble the embodiment of FIG. 2 but for the replacement of the adhesive structures by adhesive layers.

In so far as the manufacturing of the instant stops is concerned, it is seen that in order to reach the desired altitudinal dimension, a stop may be sized down or sized upward. Thus a standard unit may be made with releasably removable layers of adhesive and body portions which can be separated from the next adjacent adhesive layer by finger pulling force to yield the correct altitude necessary for proper installation, or, a body base portion can have one or more additional body intermediate and body top portions adhesed consecutively to one another with either adhesive layers or adhesive structures. The only difference between body intermediate and body top portions being the length thereof if the preferred arc shape unit is to be constructed. If a rectangular configuration is to be employed, then of course, body base, intermediate and top portions would be equidimensional.

Typically, a plural layer stop would be about 0.5 inch to 1.5 inches long, about 1/5 to ½ inch wide and for the body portion without adhesive, about 3/32 to 9/32 inch thick per layer. A mono body portion would in toto be within the range of about 7/32 inch to just about 1 inch thick for all household installations.

In installing the instant devices, especially with sliding doors, it is seen that the clearance between the bottom of the device or of the elevation means when such is employed should be less than 0.25 inch. If the gap is larger, then the door will be capable of being lifted up and off the bottom track, thereby allowing entrance to the house or building. Since windows of all sizes have a full U-shape bottom channel as well as a U-shaped top channel, the tolerance level is larger here than with doors which normally run only on a slightly raised bar utilizing a rolling wheel upon said bar.

It is also within the scope of this invention to increase the elevation by the use of shims, one or more as is required, upon the basic unit. Thus, the embodiment of FIG. 1, could be built up with a shim comprising a relatively thin body section of similar depth and width measurements with an adhesive coating or adhesive structure on on one side thereof. Preferably a release layer is included to preserve the adhesive capacity. One or more of these shims would be added to the top surface of a basic unit, such that the shim and basic unit were in superposed contiguous relationship, thereby giving rise to a structure such as that of FIG. 2. Obviously the embodiment of FIG. 3 can also be further increased in elevation in like manner.

It will now be seen that any one of the described and illustrated stops forming the basis of the instant invention may be secured within the upper channel framework for a door or window to prevent the intentional removal of the door or window. It is readily recognized that if such removability is desired, when said door or window is in the open position, such that access can be had to the secured stop, that the stop may be readily removed by a grasping and downward movement of the hand upon the instant stop.

The instant stops may be applied by persons of all ages to the framework, while the door or window is in the open position such that when said door or window is closed, access cannot be had to the stop.

It will be further seen that while only one stop is necessary to prevent or limit the opening of the closure, it may entail additional safety if 2 stops are secured at opposite sides of the closure frame.

While the invention has been described in connection with specific embodiments thereof, it will be understood that it is capable of further modification, and this application is intended to cover any variations, uses or adaptation of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. A sliding door or window removal prevention device which comprises a plurality of layers, in superposed relationship upon a body portion comprises a segmented body consisting of a plurality of alternating superposed layers of body material, and adhesive, terminating in a body material layer, which has a flat top surface, the uppermost being release layer, followed by an adhesive structure, said adhesive structure being disposed upon said surface, wherein the device is dimensioned vertically to fit above the door or window and does not interfere with the lateral movement of said door or window, when inserted into operative position on the underside of the top track.

2. In the device of claim 1 wherein the adhesive structure comprises a plurality of superposed vertical layers one upon the other, the uppermost being an adhesive layer, followed by a backing layer, the bottom most being a second adhesive layer.

3. The device of claim 1 wherein the body portion is semi-circular.

4. The device of claim 3 wherein the body material is an acrylic plastic and said body is semi-circular in configuration.

5. The device of claim 1 wherein an elevation adjusting means is secured to said body portion.

6. In the device of claim 5 wherein the elevation adjusting means is a screw threadingly engaged upwardly into said body portion.

7. In the device of claim 1 wherein depending vertically therefrom and threadingly engaged with the body portion is an elevation adjusting screw.

8. In the device of claim 1 wherein the body portion is rectangular with the lower corners being chamfered.

9. In the device of claim 1 wherein the adhesive structure consists of a layer of adhesive interposed between the release layer and the body portion and said body portion is semi-circular.

10. In the device of claim 6 wherein the body portion comprises a plurality of superposed layers alternating between body portion material, and adhesive structure, the lowermost of said layers being body portion material, wherein said screw is threadingly engaged only in the lowermost body layer.

11. In the device of claim 10 wherein the adhesive structure comprises a plurality of superposed vertical layers, one upon the other, and the uppermost being an adhesive layer, followed by a backing layer, the bottom most being a second adhesive layer.

12. In the device of claim 6 wherein interposed longitudinally across the thickness of said adhesive structure, dividing said adhesive structure into two substantially equal sections, is a release layer, said release layer being longer in dimension than the two portions of the adhesive structure abutting said release layer, thereby forming a tab for easy removal of the portion above or below the release layer from the balance of the device.

13. In the device of claim 12 wherein each adhesive structure comprises a plurality of superposed vertical layers, one upon the other, the uppermost being an adhesive layer followed by a backing layer, the bottom most being a second adhesive layer.

14. In the device of claim 13 wherein each adhesive structure consists of a layer of adhesive.

15. In the device of claim 14 wherein an elevation adjusting means is secured to said device for adjusting the effective elevation of said device.

16. The device of claim 15 wherein the elevation adjusting device consists of a screw depending upwardly into said device and threadingly engaged with said device.

* * * * *